US006019645A

United States Patent [19]

Avery et al.

[11] Patent Number: 6,019,645

[45] Date of Patent: Feb. 1, 2000

[54] ELECTRICAL CONNECTOR ASSEMBLY WITH TERMINAL POSITION ASSURANCE DEVICE

[75] Inventors: Hazelton P. Avery, Batavia; Donald J. Brinkman, Bolingbrook, both of Ill.

[73] Assignee: Molex Incorporated, Lisle, Ill.

[21] Appl. No.: 08/997,643

[22] Filed: Dec. 23, 1997

[51] Int. Cl.[7] ..... H01R 13/514

[52] U.S. Cl. ..... 439/752; 439/456; 439/449; 439/471

[58] Field of Search ..... 439/752, 471, 439/473, 456, 449, 752.5

[56] References Cited

U.S. PATENT DOCUMENTS

| | | | |
|---|---|---|---|
| 4,867,712 | 9/1989 | Kato et al. | 439/752 |
| 4,875,875 | 10/1989 | Archer et al. | 439/456 |
| 4,900,277 | 2/1990 | Inaba et al. | 439/752 |
| 4,946,399 | 8/1990 | Kawashima | 439/752 |
| 4,975,082 | 12/1990 | Nagasaka et al. | 439/595 |
| 4,979,913 | 12/1990 | Aiello et al. | 439/596 |
| 5,006,960 | 4/1991 | Kallin et al. | 439/449 |
| 5,037,336 | 8/1991 | Betsui | 439/752 |
| 5,044,972 | 9/1991 | Ikeda | 439/268 |
| 5,059,142 | 10/1991 | Ohta et al. | 439/752 |
| 5,061,210 | 10/1991 | Jinno | 439/752 |
| 5,066,252 | 11/1991 | Kato et al. | 439/752 |
| 5,066,253 | 11/1991 | Kameyama | 439/752 |
| 5,071,374 | 12/1991 | Plocek et al. | 439/752 |
| 5,120,269 | 6/1992 | Endo et al. | 439/752 |
| 5,123,866 | 6/1992 | Endo et al. | 439/752 |
| 5,160,283 | 11/1992 | Fry et al. | 439/752 |
| 5,171,155 | 12/1992 | Mendoza | 439/449 |
| 5,183,418 | 2/1993 | Yamanashi et al. | 439/752 |
| 5,316,504 | 5/1994 | Jinno | 439/752 |
| 5,454,740 | 10/1995 | Sakano et al. | 439/752 |
| 5,460,550 | 10/1995 | Okayasu et al. | 439/752 |
| 5,462,458 | 10/1995 | Sagawa | 439/752 |
| 5,520,550 | 5/1996 | Okabe | 439/456 |
| 5,620,346 | 4/1997 | Okumura | 439/752 |
| 5,624,273 | 4/1997 | Myer | 439/752.5 |
| 5,647,775 | 7/1997 | Polgar et al. | 439/752 |
| 5,647,777 | 7/1997 | Sasai et al. | 439/752 |
| 5,653,613 | 8/1997 | Shimoda | 439/752 |
| 5,683,272 | 11/1997 | Abe | 439/752.5 |
| 5,700,156 | 12/1997 | Bussard et al. | 439/471 |

*Primary Examiner*—Paula Bradley
*Assistant Examiner*—Tho D. Ta
*Attorney, Agent, or Firm*—Stacey E. Caldwell

[57] ABSTRACT

An electrical connector assembly includes a terminal position assurance (TPA) system. The assembly includes a connector housing having at least one terminal-receiving cavity. A terminal is received in the cavity and is adapted for terminating an electrical wire which extends from the terminal to the exterior of the housing. A TPA device is mountable on the housing and is engageable with the terminal. The TPA device has a strain relief portion engageable with the electrical wire. The TPA device also has a wire routing portion engageable with the electrical wire.

12 Claims, 4 Drawing Sheets

ELECTRICAL CONNECTOR ASSEMBLY WITH TERMINAL POSITION ASSURANCE DEVICE

FIELD OF THE INVENTION

This invention generally relates to the art of electrical connectors and, particularly, to an electrical connector assembly which incorporates an improved terminal position assurance (TPA) device that detects an incompletely or incorrectly inserted terminal and provides both a strain relief means and a wire routing means for electrical wires terminated to the terminals.

BACKGROUND OF THE INVENTION

Generally, an electrical connector includes a dielectric housing mounting at least one electrically conductive terminal therein. The terminal is electrically connected to another circuit component, such as a discrete electrical wire. Connectors often are employed in mateable pairs such that each terminal and the housing of one connector are mateable with a corresponding terminal and the housing of another connector.

Electrical connector assemblies are used in a wide variety of applications where it is necessary to electrically interconnect a plurality of electrical wires to perform various functions. The terminals of electrical connectors frequently are small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. A pulling force on an electrical wire secured to a terminal may cause a temporary break in the electrical contact between the terminal and another terminal of a mating connecting device.

More severe pulling forces on the electrical wire and/or the terminal may cause a partial or complete disconnection. In either event, even a momentary break in the electrical connection may result in spurious operation of an electrically driven device or an electrical circuit associated with the connector.

To avoid these problems, it often is required to provide connectors with some form of a terminal position assurance (TPA) system to detect incomplete and incorrect insertion of the terminals. In some applications, the TPA system or device also performs the function of locking the terminals in the connector housing.

Still further, in using a typical terminal retainer or TPA device, if the retainer detects that one or more terminals are not fully seated, the connector is inspected to locate the incompletely inserted terminal. In some instances, the TPA device not only detects an incompletely inserted terminal, but the device, itself, is used to move the incompletely inserted terminal to its fully inserted position. Regardless of whether the terminal retainer or TPA device is used in a "detect" system or in a "detect and correct" system, the electrical connector assemblies often are made unduly complicated to accommodate these safety considerations.

In addition to the use of TPA devices, some electrical connectors add some form of strain relief means for engaging the electrical wires. The strain relief means are effective to "absorb" pulling forces on the wires so that the pulling forces are not transmitted to the terminals of the connector. The addition of a strain relief means causes problems in further complicating the electrical connector assemblies and/or unduly enlarging the assemblies by providing the additional strain relief components or features.

Still other connector assemblies include some form of wire routing means which are provided to route the electrical wires in a given direction as the wires exit the connector assembly. For instance, it may be desirable to have the wires exit the connector assembly at right angles to their axial directions and the longitudinal directions of the connector terminals so that the connector assembly is easily positionable or assembled in its chassis or other supporting structure. Again, such wire routing means still further complicate the connector assemblies and/or unduly enlarge the assemblies to accommodate the wire routing components or features.

The present invention is directed to solving the above myriad of problems by providing a unique, single TPA device which performs multiple functions of assuring the proper position of the terminals, providing a strain relief means for the electrical wires terminated to the terminals and also providing a wire routing means for the electrical wires.

SUMMARY OF THE INVENTION

An object, therefore, of the invention is to provide a new and improved terminal position assurance (TPA) system or device in an electrical connector assembly, of the character described above.

Another object of the invention is to provide a new and improved TPA device which includes a wire strain relief means.

A further object of the invention is to provide a new and improved TPA device which includes a wire routing means.

Still another object of the invention is to provide a new and improved TPA device which includes both a wire strain relief means as well as a wire routing means.

In the exemplary embodiment of the invention, the electrical connector assembly includes a connector housing having at least one terminal-receiving cavity. A terminal is received in the cavity and is adapted for terminating an electrical wire which extends from the terminal to the exterior of the housing. A TPA device is mountable on the housing and is engageable with the terminal. The TPA device has a strain relief portion engageable with the electrical wire. The TPA device is a one-piece structure, having the strain relief portion integral therewith.

The invention also contemplates that the TPA device may also include a wire routing portion engageable with the electrical wire. Like the strain relief portion, the wire routing portion may be molded integrally with the TPA device.

As disclosed herein, the TPA device is mounted on the outside of the housing. The TPA device includes a terminal-engaging portion extending through the housing into the terminal-receiving cavity. Both the strain relief portion and the wire routing portion are located exteriorly of the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
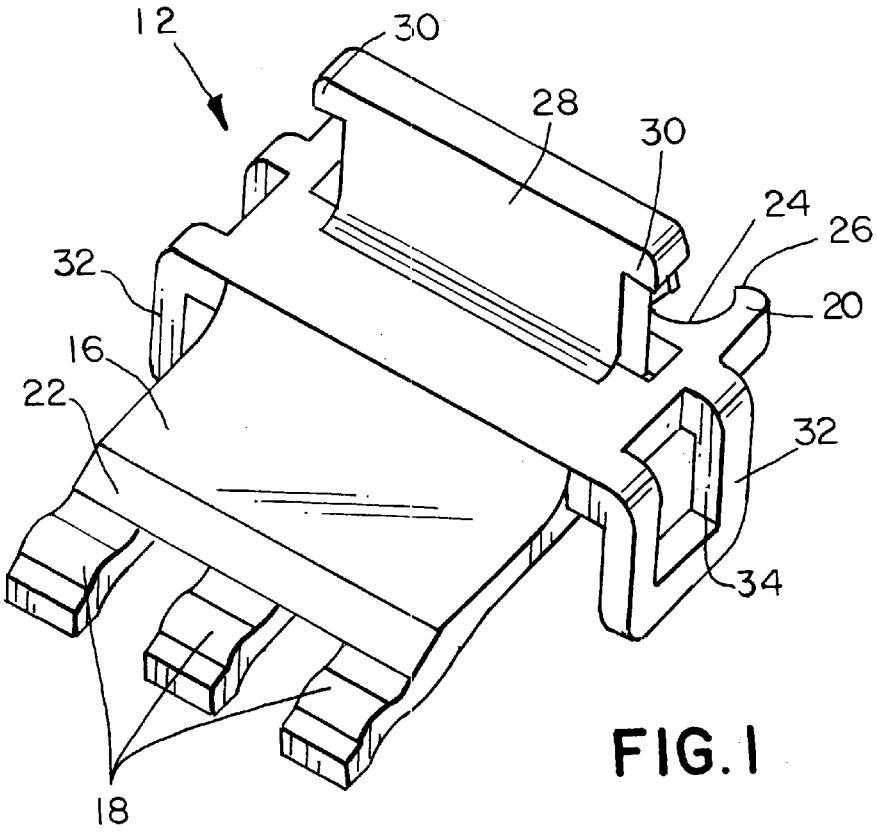
FIG. 1 is a perspective view of the TPA device incorporating the concepts of the invention.

Referring to the drawings in greater detail, the invention is embodied in an electrical connector assembly, generally designated 10 in FIGS. 5 and 6 and described hereinafter, which includes a terminal position assurance (TPA) system including a TPA device, generally designated 12 in FIGS. 1 and 2, which is mounted on a connector housing, generally designated 14 in FIGS. 3 and 4.

Figure 2:
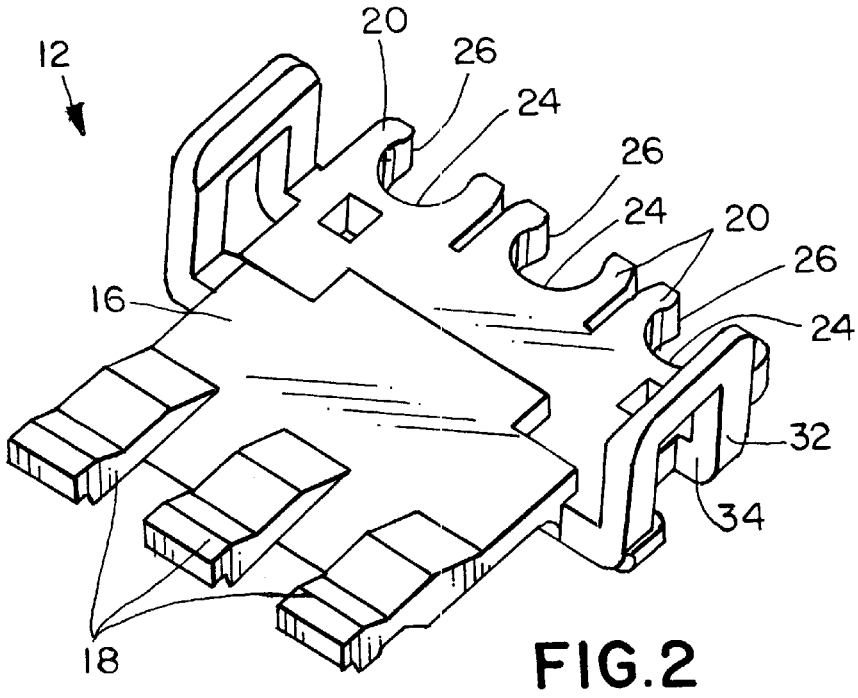
FIG. 2 is a perspective view of the TPA device taken at a different angle from that of FIG. 1.

Referring first to FIGS. 1 and 2, TPA device 12 includes a generally rectangular body portion 16 having a forward insertion end defined by a plurality of forwardly projecting fingers 18, and a rear end defined by a plurality of recessed portions 20. The TPA device includes three fingers 18 and three recessed portions 20 corresponding to three terminals and three electrical wires terminated in connector assembly 10, as described hereinafter. However, it should be understood that the connector assembly, including the concepts of the invention, may include less than or more than three terminals/electrical wires and respective fingers and recessed portions.

Still referring to FIGS. 1 and 2, fingers 18 project forwardly from the bottom of body portion 16 as best seen in FIG. 2, so that the fingers are stepped downwardly, as at 22 (FIG. 1), from the top of the body portion. Recessed portions 20 have generally circular recesses 24 defining entry mouths 26 for the insertion thereinto of electrical wires in a direction generally perpendicular to the longitudinal axes of the wires. Entry mouths 26 are smaller than the diameters of the electrical wires such that the wires can be snapped into retention engagement in recesses 24 of recessed portions 20 at the rear of the TPA device.

TPA device 12 further includes a strain relief flange 28 which projects upwardly from body 16 as best seen in FIG. 1. The strain relief flange has a pair of hooks 30 projecting outwardly from opposite sides thereof. As will be seen hereinafter, the strain relief flange 28 is effective for engaging electrical wires that exit the electrical connector assembly, as a wire tie (described hereinafter) is wrapped about the wires and the strain relief flange beneath hooks 30. The invention contemplates the possibility of more than one strain relief flange projecting from the body, particularly in the case of larger connector sizes and additional strain relief, although the drawings show only a single strain relief flange.

Finally, TPA device 12 includes a pair of latches 32 for locking the TPA device onto the connector housing. The latches are generally U-shaped to define openings 34 which snap behind latch bosses on the connector housing. The entire TPA device 12, including TPA fingers 18, wire routing recessed portions 20, strain relief flange 28 and latches 32, is a one-piece structure unitarily molded of dielectric material such as plastic or the like.

Figure 3:
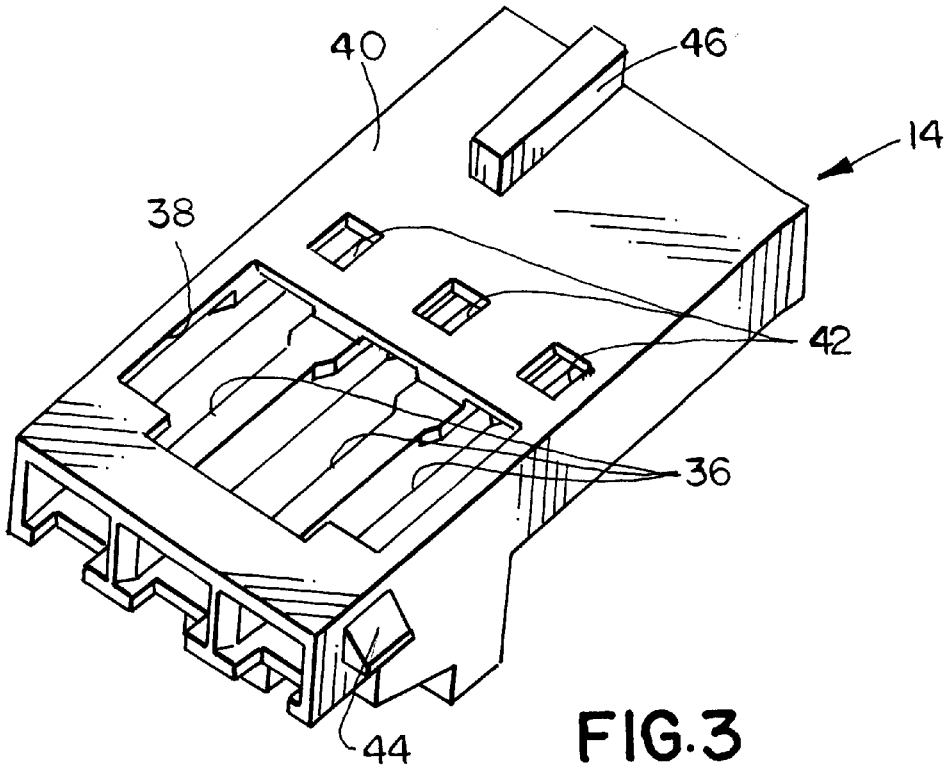
FIG. 3 is a perspective view of the connector housing on which the TPA device is mounted.
Figure 4:
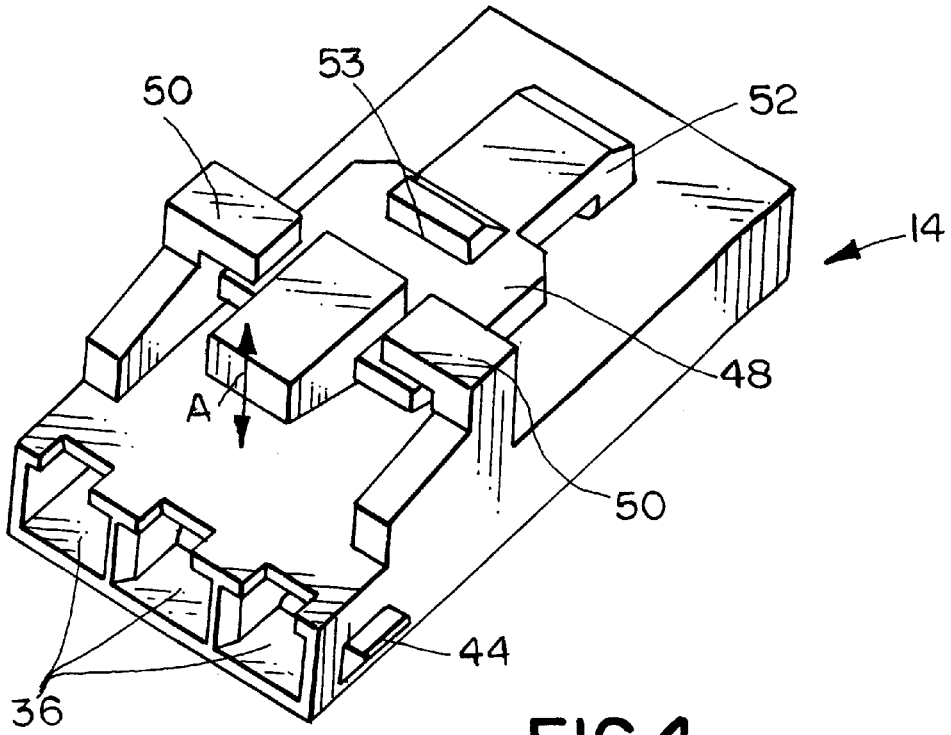
FIG. 4 is a perspective view of the connector housing taken at an angle different from that of FIG. 3.

Referring to FIGS. 3 and 4, connector housing 14 also is a one-piece structure unitarily molded of dielectric material such as plastic or the like. The housing includes three terminal-receiving cavities 36 within the interior thereof. A window or opening 38 is provided in an outside wall 40 communicating with cavities 36. Three terminal locking holes 42 also are provided in outside wall 40, for purposes to be described hereinafter. A pair of chamfered latch bosses 44 project outwardly from opposite sides of housing 14 for interengagement with latches 32 of TPA device 12. The latch bosses are chamfered or angled so that they facilitate spreading latches 32 apart as the TPA device is mounted on the housing, whereafter latches 32 snap into locking engagement behind latch bosses 44. In addition, latch bosses 44 and latches 32 are both tapered so that when a force is applied to the TPA device, either along the axis of the terminal-receiving cavities or perpendicular thereto, the latches will actually tend to tighten as opposed to slipping off the bosses.

Although not directly relevant to the concepts of the invention, connector housing 14 also has a polarizing rib 46 (FIG. 3) on one side thereof and a latch arm 48 (FIG. 4) on the opposite side thereof. These components cooperate with a complementary connector assembly or other connecting device with which connector assembly 10 is mated. As seen in FIG. 4, a pair of inwardly directed stop flanges 51 provide an anti-overstress means for latch arm 48. The latch arm is flexible in the direction of double-headed arrow "A", about a pivot 52, as a latch boss 53 engages the complementary mating connector or other connecting device.

Figure 5:
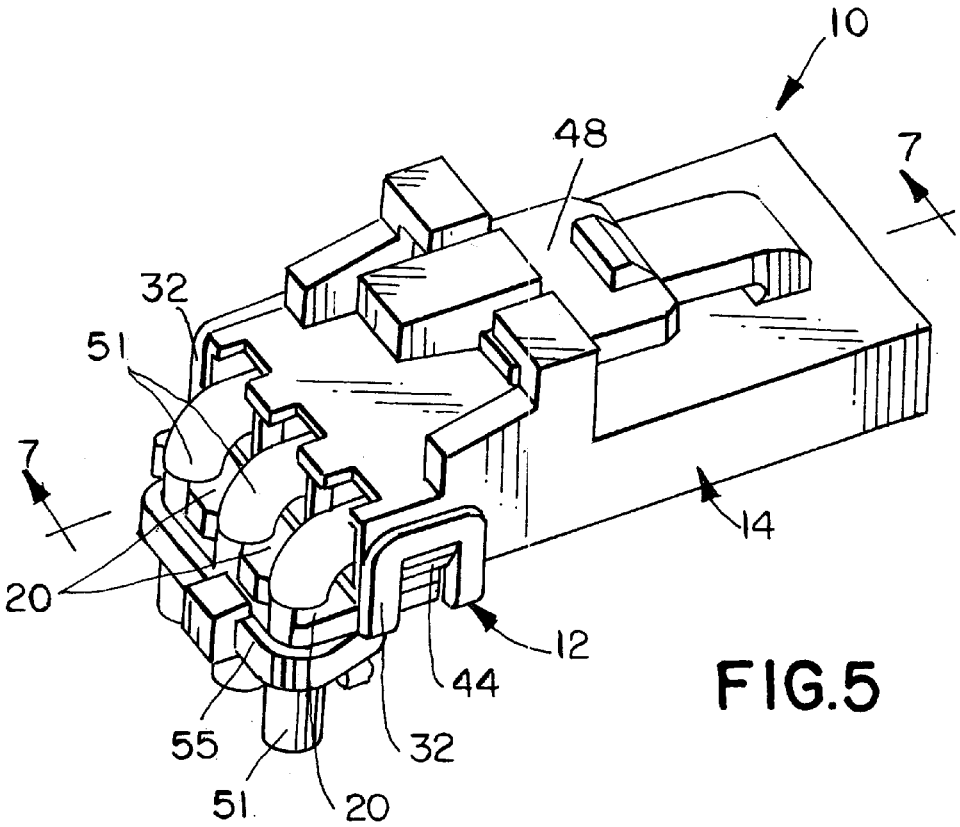
FIG. 5 is a perspective view of the completely assembled connector assembly including the TPA device of FIGS. 1 and 2 and the housing of FIGS. 3 and 4.
Figure 6:
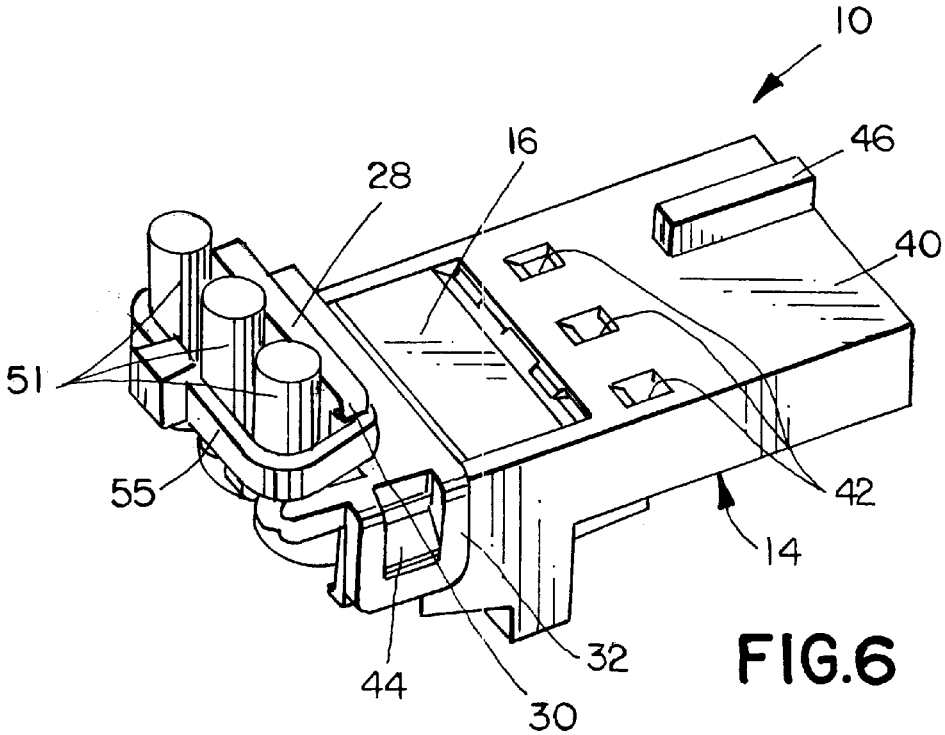
FIG. 6 is a perspective view of the connector assembly taken at a different angle from that of FIG. 5.

FIGS. 5 and 6 show TPA device 12 mounted substantially on the outside of connector housing 14, with latches 32 of the TPA device latchingly engaging latch bosses 44 of the housing. These figures show three electrical wires 51 projecting outwardly of the rear end of the housing and snapped into recessed portions 20, whereby the recessed portions provide a wire routing means for the connector. In other words, it can be seen that the wires exit the connector on their longitudinal axes, but the wires are bent at right angles to their axes and routed through recessed portions 20, and the recessed portions maintain the wires in this routing configuration.

In addition, FIGS. 5 and 6 show a wire tie 55 wrapped around strain relief flange 28 beneath hooks 30 at opposite sides of the flange. Therefore, the electrical wires are in engagement with strain relief flange 28 and any pulling forces on the wires are "absorbed" by the strain relief flange, and the pulling forces are not transmitted to the terminals inside the connector housing.

Figure 7:
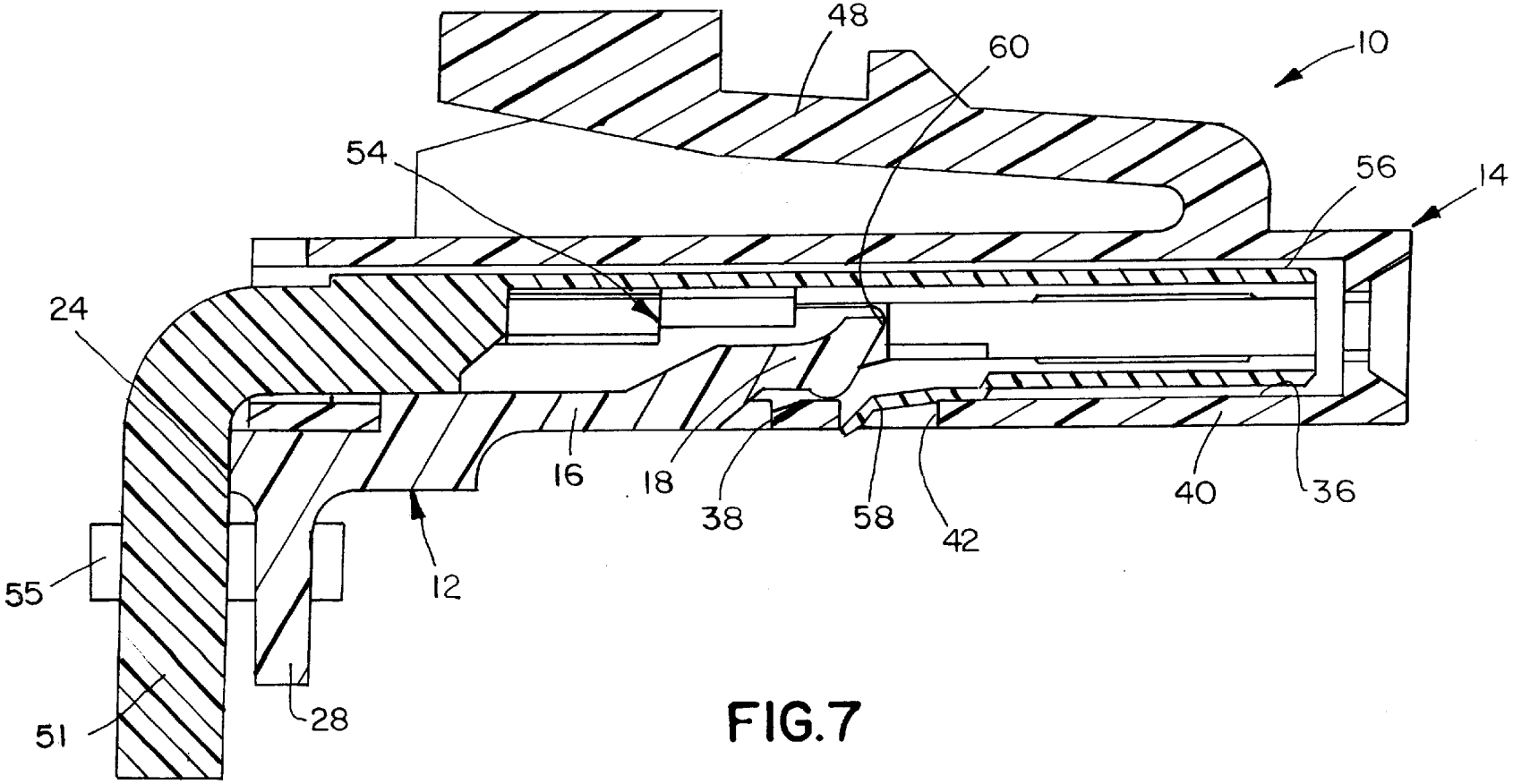
FIG. 7 is a section taken generally along line 7—7 of FIG. 5.

FIG. 7 shows the fully assembled condition of electrical connector 10, including TPA device 12 and housing 14, and with a terminal, generally designated 54, inserted into one of the terminal-receiving cavities 36 of the housing. The terminal is terminated to one of the electrical wires 51 routed into one of the recesses 24, with wire tie 55 holding the wire to strain relief flange 28. One of the terminals is inserted into each terminal-receiving cavity.

Still referring to FIG. 7, each terminal 54 is stamped and formed of sheet metal material and includes a front mating end 56 which is generally hollow to configure the terminal as a female terminal for receiving a male terminal pin of the complementary mating connector. Each terminal has a flexible locking tab 58 which snaps into a respective one of the terminal locking holes 42 in the connector housing. Each terminal also has a locking shoulder 60 which is engageable by a respective one of the fingers 18 of the TPA device. In essence, locking tabs 58 of the terminals provide a primary lock within locking holes 42 in the housing, and locking shoulders 60 provide a secondary lock with the fingers 18 of the TPA device.

FIG. 7 also shows how fingers 18 of the TPA device are offset from body portion 16 such that the fingers project through the housing into the terminal-receiving cavities 36 and into engagement with locking shoulders 60 of the terminals. Actually, body portion 16 of the TPA device seats within window 38 of the housing whereby the top of the body portion is generally flush with the outside of wall 40 of the housing. Of course, if one of the terminals is inserted only to an extent that locking shoulder 60 is not at a position for initial engagement by the respective finger 18 of the TPA device, the TPA device simply will "detect" this condition because the terminal will completely block the finger and prevent the TPA device from being mounted on the connector housing. Similarly, if one of the terminals is inserted, either partially or completely, within its terminal-receiving cavity in an incorrect orientation, the TPA device will also "detect" this condition. That is to say, terminal 54 is properly oriented within terminal-receiving cavity 36 when locking shoulder 60 is positioned such that is engageable by a respective one of the fingers 18 of the TPA device, that is, such that it is facing the window 38 of the connector housing. If a terminal is incorrectly inserted such that it is improperly oriented, the TPA device cannot be properly and completely inserted such that the respective finger 18 can engage the locking shoulder 60.

Finally, it can be understood from FIG. 7 that if a terminal 54 is not fully inserted into its respective terminal-receiving cavity, and if the terminal is partially inserted to the extent that the respective finger 18 engages locking shoulder 60 on the terminal at an early point in the insertion movement of the TPA device, the TPA device is effective to push the terminal to its fully inserted position. Therefore, the TPA device acts as a "detect and correct" system as described above.

From the foregoing, it can be understood that TPA device 12 is very unique in its multi-function features. The TPA device not only detects an incompletely or incorrectly inserted terminal, but the TPA device can correct the situation by pushing the terminal to its fully inserted position. The TPA device also provides a wire routing means for the electrical wires terminated to the terminals. The TPA device further provides a strain relief means for the electrical wires exiting from the connector assembly. All of these functions are provided in a simple one-piece, unitarily molded component.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a terminal position assurance (TPA) system, an electrical wire strain relief system comprising:

a connector housing having at least one terminal receiving cavity;

a terminal received in the cavity and being adapted for terminating an electrical wire which extends from the terminal to the exterior of the housing;

a TPA device mountable on the housing and being engageable with the terminal, the TPA device having a strain relief portion engageable with the electrical wire and a wire routing portion engageable with the electrical wire, wherein said wire routing portion of the TPA device is located exteriorly of the connector housing, and wherein said wire routing portion comprises a recessed portion of the TPA device for embracing the electrical wire and said recessed portion has an entry mouth for the electrical wire, the entry mouth being smaller than the diameter of the wire such that the wire can be snapped into retentive engagement in the recessed portion.

2. In the electrical connector assembly of claim 1, including means for mounting the TPA device on the outside of the connector housing.

3. In the electrical connector assembly of claim 2, wherein said TPA device includes a terminal-engaging portion extending through the housing into said cavity.

4. In the electrical connector assembly of claim 3, wherein said strain relief portion of the TPA device is located exteriorly of the connector housing.

5. In the electrical connector assembly of claim 4, including a wire tie for tieing the electrical wire to the strain relief portion.

6. In an electrical connector assembly which includes a terminal position assurance (TPA) system, an electrical wire routing system comprising:

a connector housing having at least one terminal-receiving cavity;

a terminal received in the cavity and being adapted for terminating an electrical wire which extends from the terminal to the exterior of the housing; and a TPA device mountable on the housing and being engageable with the terminal, the TPA device having a wire routing portion engageable with the electrical wire, wherein said wire routing portion comprises a recessed portion of the TPA device for embracing the electrical wire and said recessed portion has an entry mouth for the electrical wire, the entry mouth being smaller than the diameter of the wire such that the wire can be snapped into retentive engagement in the recessed portion.

7. In the electrical connector assembly of claim 6, including means for mounting the TPA device on the outside of the connector housing.

8. In the electrical connector assembly of claim 7, wherein said TPA device includes a terminal-engaging portion extending through the housing into said cavity.

9. In the electrical connector assembly of claim 8, wherein said wire routing portion of the TPA device is located exteriorly of the connector housing.

10. In an electrical connector assembly which includes a terminal position assurance (TPA) system, an electrical wire strain relief and routing system comprising:

a connector housing having at least one terminal-receiving cavity;

a terminal received in the cavity and being adapted for terminating an electrical wire which extends from the terminal to the exterior of the housing; and a TPA device mountable on the outside of the connector housing and including a terminal-engaging portion extending through the housing into the cavity and being engageable with the terminal, the TPA device having a strain relief portion located exteriorly of the connector housing and engageable with the electrical wire, and wire routing portion located exteriorly of the housing and engageable with the electrical wire, wherein said wire routing portion comprises a recessed portion of the TPA device for embracing the electrical wire and said recessed portion has an entry mouth for the electrical wire, the entry mouth being smaller than the diameter of the wire such that the wire can be snapped into retentive engagement in the recessed portion.

11. In the electrical connector assembly of claim 10, including a wire tie for tieing the electrical wire to the strain relief portion.

12. In the electrical connector assembly of claim 10, including a plurality of said terminals mounted in a plurality of said terminal-receiving cavities in the connector housing, a plurality of said terminal-engaging portions on the TPA device for engaging the plurality of terminals, and a plurality of said wire routing portions engageable with a plurality of electrical wires terminated to the terminals.

* * * * *